US009850034B2

(12) United States Patent
Tan

(10) Patent No.: US 9,850,034 B2
(45) **Date of Patent: *Dec. 26, 2017**

(54) SELF-OPENING BAGS WITH ATTACHING FEATURES

(71) Applicant: Daniel Brian Tan, Harahan, LA (US)

(72) Inventor: Daniel Brian Tan, Harahan, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/593,703

(22) Filed: May 12, 2017

(65) Prior Publication Data

US 2017/0247148 A1 Aug. 31, 2017

Related U.S. Application Data

(60) Division of application No. 14/615,791, filed on Feb. 6, 2015, now Pat. No. 9,676,523, which is a division of application No. 13/771,759, filed on Feb. 20, 2013, now Pat. No. 8,979,367, which is a continuation of application No. PCT/US2011/067515, filed on Dec. 28, 2011.

(51) Int. Cl.

| | |
|---|---|
| ***B65D 33/00*** | (2006.01) |
| ***B65D 30/20*** | (2006.01) |
| ***B65H 75/32*** | (2006.01) |
| ***B65H 75/44*** | (2006.01) |

(52) U.S. Cl.

CPC ..... *B65D 33/007* (2013.01); *B65D 31/10* (2013.01); *B65D 33/002* (2013.01); *B65H 75/32* (2013.01); *B65H 75/4468* (2013.01)

(58) Field of Classification Search

CPC .... B65D 31/10; B65D 33/007; B65D 33/002; B65D 33/001; B65D 33/065; B65D 33/14; B65H 75/32; B65H 75/4468

USPC ..... 383/33, 8, 9, 37; 206/554

See application file for complete search history.

(56) References Cited

U.S. PATENT DOCUMENTS

| | | | | |
|---|---|---|---|---|
| 3,349,991 | A * | 10/1967 | Kessler | B65D 31/16 383/120 |
| 3,411,698 | A * | 11/1968 | Reynolds | B23K 20/103 206/390 |
| 3,979,050 | A | 9/1976 | Cilia | |
| 4,078,717 | A | 3/1978 | Stearley | |
| 4,759,639 | A * | 7/1988 | DeMatteis | B65D 33/001 206/554 |
| 4,759,742 | A * | 7/1988 | Achelpohl | B31B 70/00 383/107 |

(Continued)

*Primary Examiner* — Peter Helvey

(74) *Attorney, Agent, or Firm* — David A. Belasco; Belasco Jacobs & Townsley, LLP

(57) ABSTRACT

A self-opening bag includes front and real walls joined at their respective first and second side and bottom edges. The bag is folded at least once parallel to its side edges. At least one attaching feature is located on the outer surface of the bag adjacent the upper end and between the folded walls. The bag is releasably attached to a subsequent bag. The at least one attaching feature causes the bag to open as the bag is pulled from the subsequent bag. The once folded bag may be sealed at the bottom edges after folding to form a star-sealed bag bottom. The bags may be removably attached to each other at a perforation line and wound onto a compact roll for use with a bag dispenser. The bags may have an upper seam, a U-shaped cut and a pair of bag handles. The bags may be corona treated.

10 Claims, 18 Drawing Sheets

(56) References Cited

U.S. PATENT DOCUMENTS 4,769,126 A * 9/1988 Roen ..... B65D 33/001 206/554
4,785,938 A * 11/1988 Benoit, Jr. ..... B65D 33/001 206/554
4,849,090 A 7/1989 Case
4,854,451 A * 8/1989 Jensen ..... B65D 33/001 206/493
4,904,092 A 2/1990 Campbell
4,911,560 A * 3/1990 Hoover ..... B65D 31/12 383/10
5,335,788 A * 8/1994 Beasley ..... B65D 33/001 206/554
5,346,310 A * 9/1994 Nguyen ..... B65D 33/001 206/554
5,395,298 A 3/1995 Moesmann
5,433,363 A * 7/1995 Simhaee ..... B65D 33/002 206/390
5,467,572 A * 11/1995 Wile ..... B65B 43/14 206/554
5,469,970 A * 11/1995 Li ..... B65D 33/001 206/554
5,497,884 A 3/1996 DeMatteis
5,562,580 A * 10/1996 Beasley ..... B65D 33/001 206/554
5,590,784 A * 1/1997 Daniels ..... B65D 33/001 206/554
5,662,225 A * 9/1997 DeMatteis ..... B65B 67/04 206/554
5,669,504 A * 9/1997 Leone ..... B65D 33/065 206/554
5,690,228 A * 11/1997 DeMatteis ..... B65D 33/001 206/554
5,695,064 A * 12/1997 Huang ..... A47F 13/085 206/554
5,706,961 A * 1/1998 Morano ..... A61J 9/001 215/11.3
5,752,666 A * 5/1998 Simhaee ..... B65D 33/002 206/390
5,845,779 A * 12/1998 Wilfong, Jr. ..... B65D 33/001 206/554
5,881,882 A * 3/1999 Fletcher ..... B65D 33/001 206/554
5,921,390 A 7/1999 Simhaee
5,941,393 A * 8/1999 Wilfong, Jr. ..... B65B 43/14 206/554
6,059,707 A * 5/2000 Belias ..... B65D 33/002 493/195
6,135,281 A * 10/2000 Simhaee ..... B65B 43/123 206/390
6,146,017 A 11/2000 Hodges
6,159,136 A 12/2000 Belias
6,446,811 B1 9/2002 Wilfong
6,488,222 B1 12/2002 West
6,945,695 B2 * 9/2005 Rabiea ..... B65B 43/267 383/35
7,104,942 B2 9/2006 Tan
7,223,016 B2 5/2007 Bell
7,424,963 B2 * 9/2008 Daniels ..... A47F 9/042 225/106
7,624,881 B2 * 12/2009 Wilfong, Jr. ..... A47F 13/085 211/59.1
8,408,792 B2 * 4/2013 Cole ..... B65D 75/5838 383/106
2004/0066988 A1 4/2004 Yi Li
2005/0098600 A1 * 5/2005 Yeh ..... B65D 33/002 225/93
2005/0259893 A1 * 11/2005 Chen ..... B65D 33/002 383/37
2006/0188180 A1 * 8/2006 Otsubo ..... B65D 33/001 383/35
2010/0027917 A1 2/2010 McCann
2011/0075951 A1 3/2011 Tseng
2011/0206302 A1 * 8/2011 Tan ..... B65D 33/002 383/120
2012/0027917 A1 2/2012 Shirahata

* cited by examiner

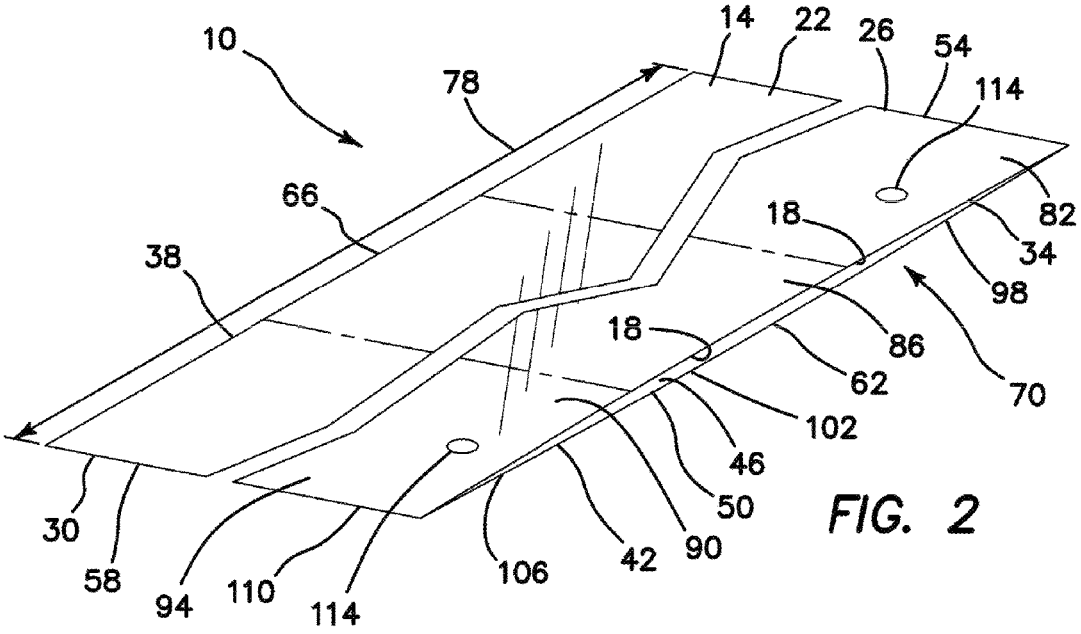
FIG. 2
FIG. 2A
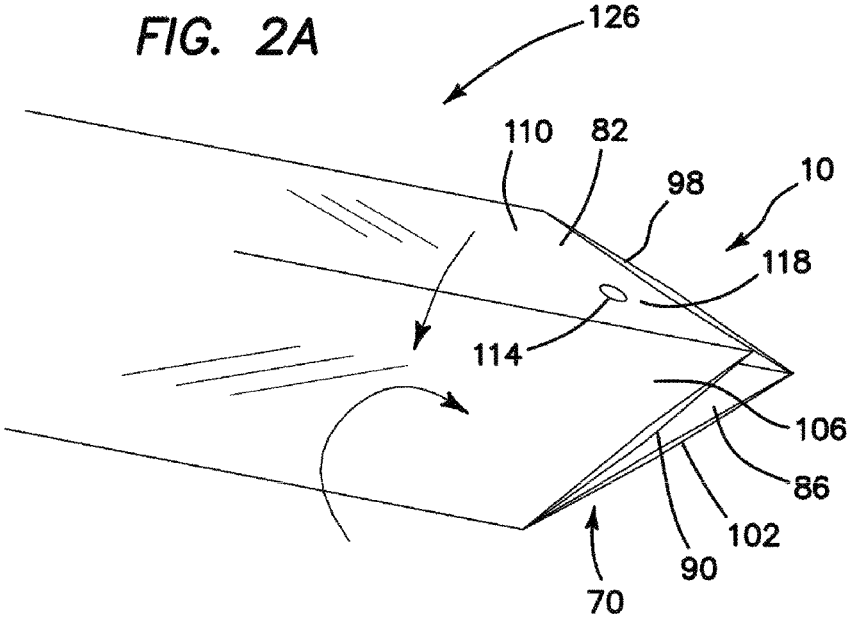

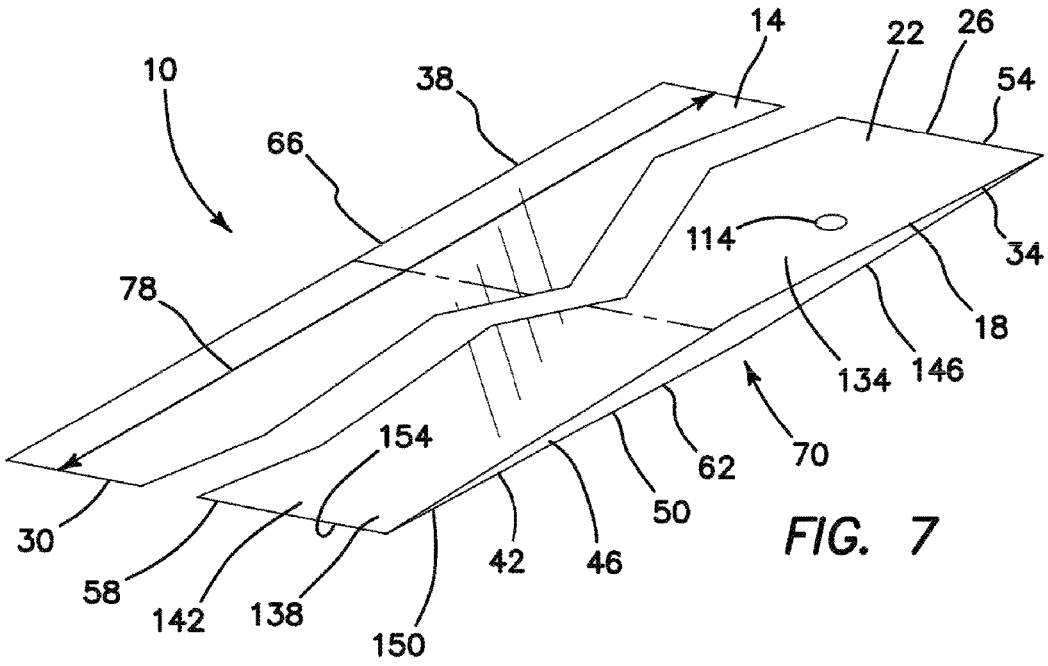
FIG. 7
FIG. 7A
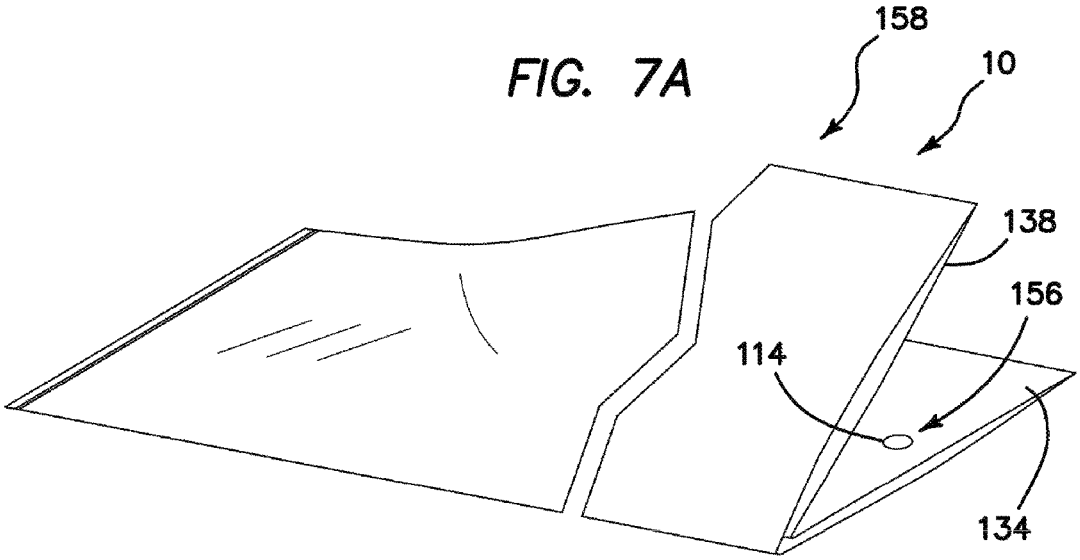

SELF-OPENING BAGS WITH ATTACHING FEATURES

RELATED APPLICATION

The instant application is a divisional of U.S. application Ser. No. 14/615,791, filed Feb. 6, 2015, and currently pending, which is a divisional of U.S. application Ser. No. 13/771,759, filed Feb. 20, 2013, now issued as U.S. Pat. No. 8,979,367 on Mar. 17, 2015, which is a continuation of PCT Application Serial No. PCT/US11/67515 filed on Dec. 28, 2011 and claims priority to the filing date thereof.

FIELD OF INVENTION

This invention relates to the field of self-opening film bags and more specifically to folded and gusseted merchandise and produce bags for which attaching features are provided to outer surfaces of the bags.

BACKGROUND OF THE INVENTION

In supermarkets and grocery stores film bags are used for fresh produce and other grocery items. Such bags provide a low cost, convenient and sanitary method for the collection and transport of otherwise unwrapped food items. Because these bags are usually made of lightweight, very flexible material and because the film used in construction of these bags is often corona treated to enhance ink adhesion, the bag surfaces tend to stick together. This makes the bags difficult to open, often requiring the use of both hands. In order to make the bags easier to use, various systems have been developed to make the bags either self opening or at least easier to open. Some of the inventions that have been developed to provide these features include the following:

U.S. Pat. No. 4,849,090, issued to Case et al., discloses a bag roll of flexible plastic material that is formed in a continuous strip of bags with transverse severance lines between the individual bags. The Patent proposes to solve a familiar problem in the dispensing of plastic film bags from rolls that normally require the use of two hands. In the first place, it is desirable to sever one bag from the roll while stabilizing the remaining portion of the roll so that additional bags are not released as the first bag is severed from the roll. Further, the actual opening of the individual bag is less than convenient since the extremely thin nature of the bag material has a static cling which tends to keep the bag closed. Of specific interest, is the solving of the second problem wherein a releasable adhesive or bonding material is placed between the outer surface of the inner panel of each bag adjacent to the mouth-defining edge and the outer surface of the outer panel of the same or a following bag aligned beneath in the roll. As the first bag is released from the roll, a greater force is provided by the adhesive so that the following bag provides sufficient resistance to allow the leading bag to be severed from the roll while simultaneously holding the remaining portion of the roll in position. As the roll is stabilized by the adhesive only a single hand is necessary to retrieve the bag and at the same time the first bag is simultaneously opened since the adhesive bonding of the inner panel of each bag adjacent to the bag mouth allows for the bag being dispensed to open more easily and thus a single one-hand operation is achieved.

The applied adhesive provides for a releasable adhering or bonding of the inner panel of each bag to the outer panel or panel portions inward thereof in the formed roll. The releasable adhesive bonding allows for the withdrawal of a leading bag from the roll with a resistance to release between the bags which is greater than the resistance required to sever one bag from the roll along the severance line or perforations. Thus, the adhesive provides a resistance to a continued unrolling of the bags while allowing the severance to take place. The opening of the bag is achieved since the adhesive lies solely between the outer surface of the inner panel of each bag and the outer surface of the underlying outer panel. The outer panel of each bag remains free of its associated inner panel at the inward edges and when the user positions the hand over the leading edge portion of the outer panel of the leading bag and the bag is forwardly drawn the mouth automatically is opened in light of the adhesive retained inner panel adjacent the mouth edge thereof. This allows the mouth of the leading bag to be substantially fully opened prior to the release of the associated inner panel adjacent to the leading or mouth defining edge thereof. All of this achieves a single-handed manipulation of the bags so that as it is removed from the roll, the roll is stabilized preventing further unrolling of the following bags and also allowing the dispensed bag to be substantially fully opened.

U.S. Pat. No. 4,904,092, issued to Campbell et al. is directed to a roll of thermoplastic bags with provision of improved openability. The bags include an area of tacky, pressure-sensitive adhesive applied to an outer surface of the bags such that when the bag is pulled from the roll or stack the adhesive temporarily adheres one side of the bag to the roll or stack and thus causes the front and back of the bag to separate slightly thus providing for an easy opening operation. When the bag is dispensed from the roll, the adhesive on the outside back surface of the bag serves to temporarily adhere that surface to the underlying roll. This causes the front and back top ends of the bag to separate slightly when a bag is dispensed. Thus, the openability of the bag is achieved more easily. More specifically, the bag is being dispensed from the stack while adhesive on the outside back surface of bag serves to temporarily adhere that surface to the underlying stack causing the front and back top ends of the bags to separate slightly as the bag is dispensed.

U.S. Patent Application No. 2004/0040974, published for Chen illustrates a plastic bag dispenser and manufacturing method thereof. An adhesive is used on top near the opening of each bag for sticking to the next below bag wherein the closed ends are bent downward toward the openings of the bags so as to form a bent section at the underside of the stack. Thus, when the user exerts a small force to pull one bag from the container through the opening assembly a second bag is prevented from being removed from the stack while as the bag is removed from the box dispenser, the opening is exposed in an open state until the bag is completely removed from the widthwise opening and disengaged from the next bag below which is adhered to the immediately above bag by adhesive until the opening is in an open state. At this point, the top halves of both folded sections and the opening of the next bag below are exposed at the top of the container.

U.S. Pat. No. 7,223,016, issued to Bell disclose a method of opening for bags of supple polymeric material subject to interlayer cling. Bags having openings in or truncated portions of gusset panels create graspable regions which can be tensioned in a direction against a region which is tensioned in another direction thus developing a tension in a first sidewall and a second sidewall allowing for a small amount of tension to cause the first sidewall and second sidewall to sheer in opposite directions and inner layer cling to be disrupted between the graspable regions.

U.S. Pat. No. 3,979,050, issued to Cilla is directed to multi-ply film articles with provision for readily separating the confronting faces of first and second plies of film. A flexible plastic film bag comprises a ply of flat flexible film superimposed over a second ply of flexible plastic film with edges joined to form a bag with an open end. A portion of the film defines the open end of the bag that is "puckered" such that distortion extends across the full width of open end of the bag. The confronting face of the portion of the film is separated from the confronting face of the opposed portion by the "puckered" distortion in the film. Thus, a means for grasping the bag is provided and the confronting faces of the two films of the bag are easily opened.

U.S. Pat. No. 6,146,017, issued to Hodges is directed to plastic bags having through bores for easy opening. This Patent is another example of a plastic bag that is dispensed from a roll or carton. The bag may have an expandable gusset near one end thereof but the open end has a plurality of through bores that are aligned and extend across the opening for facilitating the opening thereof. The through bores may extend across only one ply of the bag opening or may be offset from one another in both plies such that the bores touch one another and allow for easy opening of the film bag.

It is an objective of the present invention to provide a system for making thin film bags self-opening or easier to open. It is a further objective to provide such a system that will allow the user to open the bags with only one hand. It is a still further objective of the invention to provide a system that is not dependant upon the type of dispenser system that the bags are used with. It is yet a further objective to provide a system that can be used with bags that are folded into compact bag rolls or packs. It is another objective to provide an opening system that works with gusseted bags. Finally, it is an objective of the present invention to provide such a system that does not require adhering subsequent bags in a roll or pack together.

While some of the objectives of the present invention are disclosed in the prior art, none of the inventions found include all of the requirements identified.

SUMMARY OF THE INVENTION

The present invention addresses all of the deficiencies of prior art self-opening bag inventions and satisfies all of the objectives described above.

(1) A self opening bag providing the desired features may be constructed from the following components. A front wall is provided. The front wall has an inner surface, an outer surface, first and second side edges, a top edge and a bottom edge. A rear wall is provided. The rear wall has an inner surface, an outer surface, first and second side edges, a top edge and a bottom edge. The front wall is joined to the rear wall adjacent respective first and second side edges thereof. The front wall is sealed to the rear wall adjacent respective bottom edges thereof. An open mouth is located adjacent the top edges. The bag is folded twice parallel to the side edges to form a Z-folded bag one third of a width of the bag.

The outer surface of the front wall has first, second and third portions. Each of the portions has an upper end adjacent the open mouth. The outer surface of the rear wall has fourth, fifth and sixth portions. Each of the portions has an upper end adjacent the open mouth. At least one attaching feature is provided. The attaching feature is selected from the group that includes cold staking, hot pinning, multiple corona treatment, corona treatment with pressure points, knife cutting with pressure, wherein the knife cutting with pressure causes edges of a knife cut through adjacent bag layers to adhere together, special resin formulations, and glue spotting. The attaching feature is located at at least one of a first point between the second portion and the third portion adjacent the upper end and a second point between the fourth portion and the fifth portion adjacent the upper end. The attaching feature secures at least one of the second portion to the third portion and fourth portion to the fifth portion. The bottom edges of the folded bag are releasably attached to the top edges of a subsequent folded bag. The folded bags are rolled into a compact bag roll. The at least one attaching feature causes the bag to open as the bag is pulled from the subsequent bag.

(2) In another variant, the front and rear walls of each of the bags is removably attached by a perforation line at the bottom edges to the top edges of the subsequent bag.

(3) In still another variant, the bags include a chisel cut. The chisel cut extends through a center point of the perforation line. When the compact roll is installed in a bag dispenser the chisel cut will engage a separating tongue when bags are pulled from the roll.

(4) In yet another variant, the bags are rolled about a core.

(5) In a further variant, the bags include at least one side gusset. The side gusset extends inwardly from at least one of the first and second side edges of the front and rear walls.

(6) In still a further variant, the bag further includes a bottom gusset. The bottom gusset extends upwardly from the bottom edges.

(7) In yet a further variant, the outer surface of at least one of the front wall and the rear wall of the bags is corona treated.

(8) In another variant of the invention, the attaching feature may be a natural or synthetic substance or other attaching means not requiring a separate substance.

(9) In still another variant, the attaching feature may be sprayed, rolled or dropped on the outer bag surfaces or may involve mechanical or electrical manipulation of the bag surfaces.

(10) In a final variant, the attaching feature comprises any of mechanical and electrical manipulation of said bag surfaces.

An appreciation of the other aims and objectives of the present invention and an understanding of it may be achieved by referring to the accompanying drawings and the detailed description of a preferred embodiment.

DESCRIPTION OF THE DRAWINGS

FIG. 2 is a perspective view of a C-fold Tri-fold bag with attaching features;

FIG. 2A is a perspective view of the FIG. 2 embodiment being folded;

FIG. 7 is a perspective view of a once folded rectangular bag with attaching feature prior to folding;

FIG. 7A is a perspective view of the FIG. 7 embodiment with bottom sealed after being folded;

DETAILED DESCRIPTION OF THE PREFERRED EMBODIMENT (1) FIGS. 1-16 illustrate a self-opening bag 10 providing the desired features that may be constructed from the following components. As illustrated in FIGS. 1 and 1A, a front wall 14 is provided. The front wall 14 has an inner surface 18, an outer surface 22, first 26 and second 30 side edges, a top edge 34 and a bottom edge 38. A rear wall 42 is provided. The rear wall 42 has an inner surface 46, an outer surface 50, first 54 and second 58 side edges, a top edge 62 and a bottom edge 66. The front wall 14 is joined to the rear wall 42 adjacent respective first 26, 54 and second 30, 58 side edges thereof. The front wall 14 is sealed to the rear wall 42 adjacent respective bottom edges 38, 66 thereof. An open mouth 70 is located adjacent the top edges 34, 62. The bag 10 is folded twice parallel to the side edges 26, 54, 30, 58 to form a Z-folded bag 74 one third of a width 78 of the bag 10.

Figure 1:
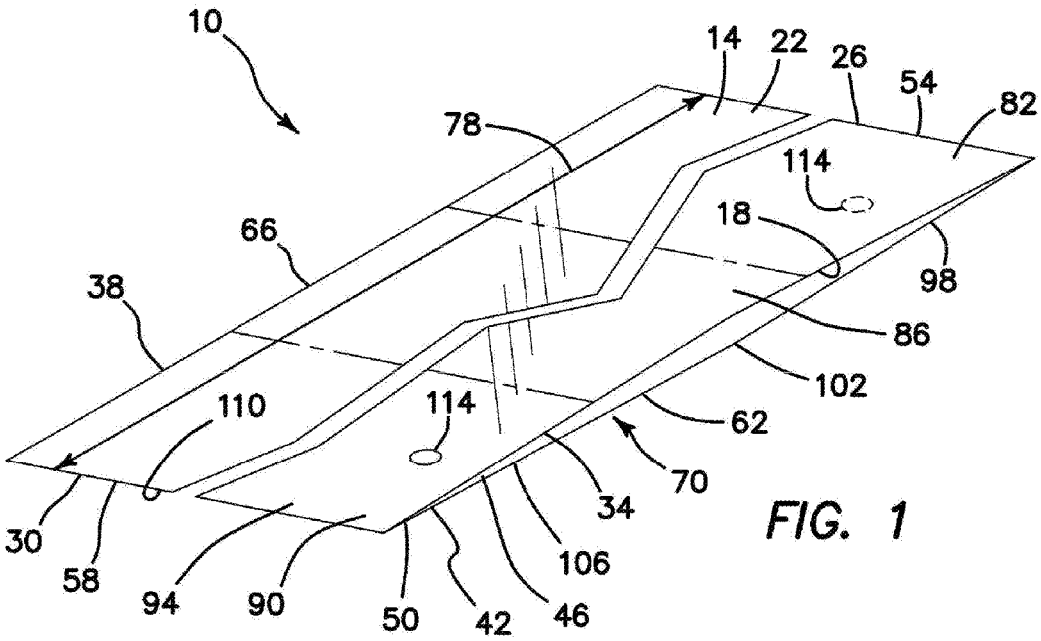
FIG. 1 is a perspective view of a Z-fold Tri-fold bag with attaching features.
Figure 1A:
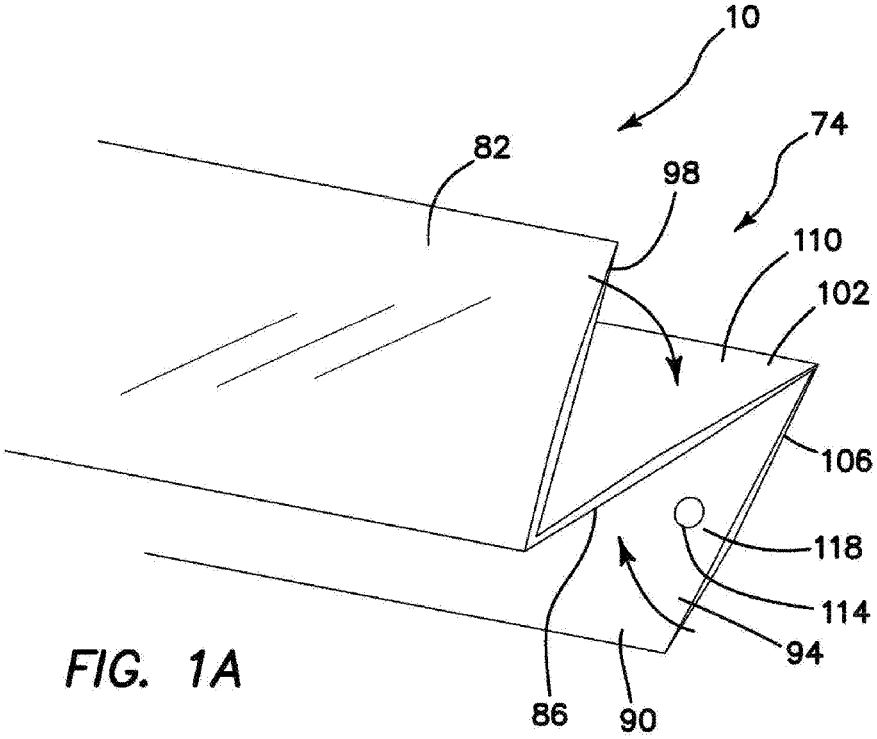
FIG. 1A is a perspective view of the FIG. 1 embodiment being folded.

The outer surface 22 of the front wall 14 has first 82, second 86 and third 90 portions. Each of the portions 82, 86, 90 has an upper end 94 adjacent the open mouth 70. The outer surface 50 of the rear wall 42 has fourth 98, fifth 102 and sixth 106 portions. Each of the portions 98, 102, 106 has an upper end 110 adjacent the open mouth 70. At least one attaching feature 114 is provided. The attaching feature is selected from the group that includes cold staking (not shown), hot pinning 242, multiple corona treatment (not shown), corona treatment with pressure points (not shown), knife cutting (not shown), special resin formulations (not shown), and glue spotting (not shown). The attaching feature 114 is located at at least one of a first point 118 between the second portion 86 and the third 90 portion adjacent the upper end 94 and a second point 122 between the fourth portion 98 and the fifth 102 portion adjacent the upper end 110. The attaching feature 114 secures at least one of the second portion 86 to the third portion 90 and fourth portion 98 to the fifth portion 102. The bottom edges 38, 66 of the folded bag 74 are releasably attached to the top edges 34, 62 of a subsequent folded bag 74. The folded bags 74 are rolled into a compact bag roll 166. The at least one attaching feature 114 causes the bag 74 to open as the bag 74 is pulled from the subsequent bag 74.

Figure 2B:
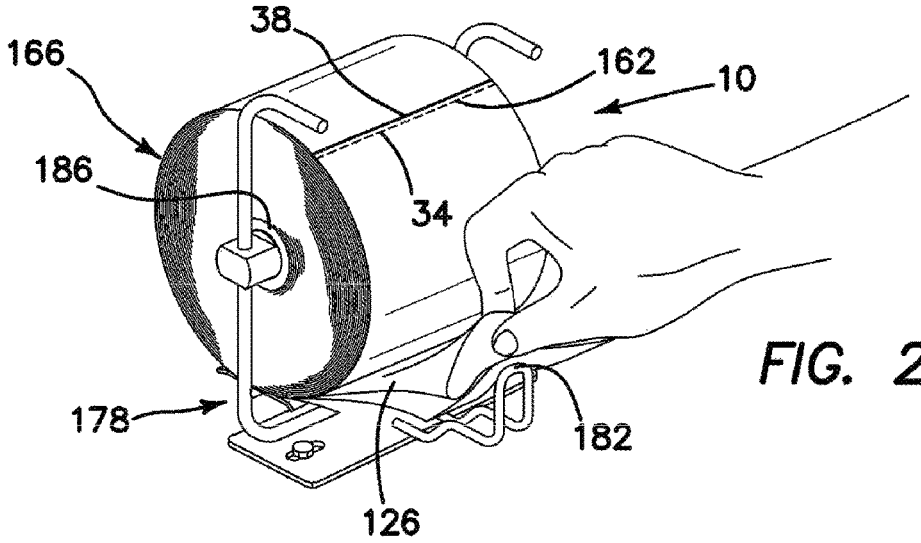
FIG. 2B is a perspective view of a compact roll of FIG. 1 bags in a dispenser illustrating the self opening feature.

(2) In a variant of the invention, as illustrated in FIG. 2B, the front 14 and rear 42 walls of each of the bags 10 is removably attached by a perforation line 162 at the bottom edges 38, 66 to the top edges 34, 62 of the subsequent bag 10.

Figure 2C:
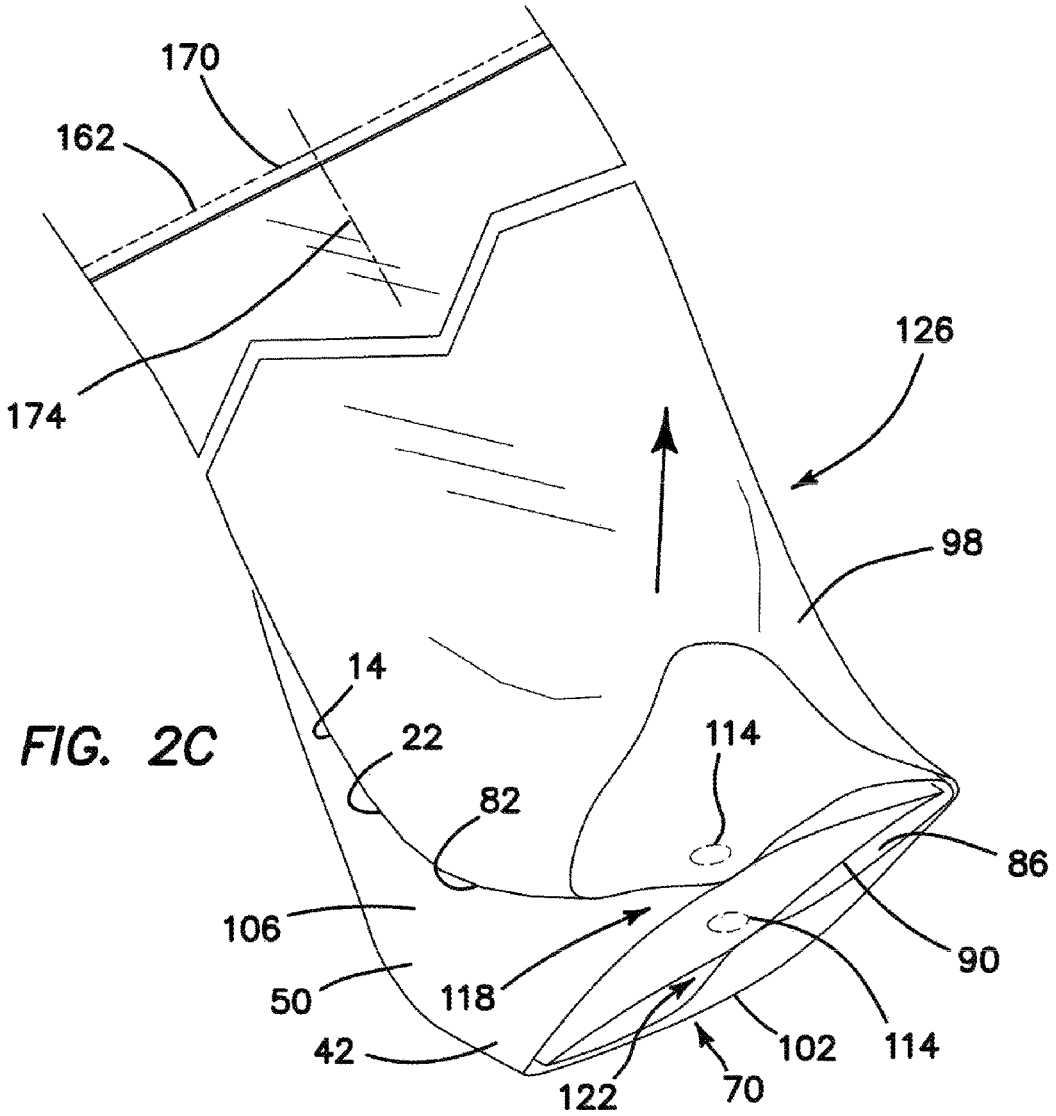
FIG. 2C is a perspective view of the FIG. 1 embodiment illustrating joined attaching features during opening of the bag.
Figure 2D:
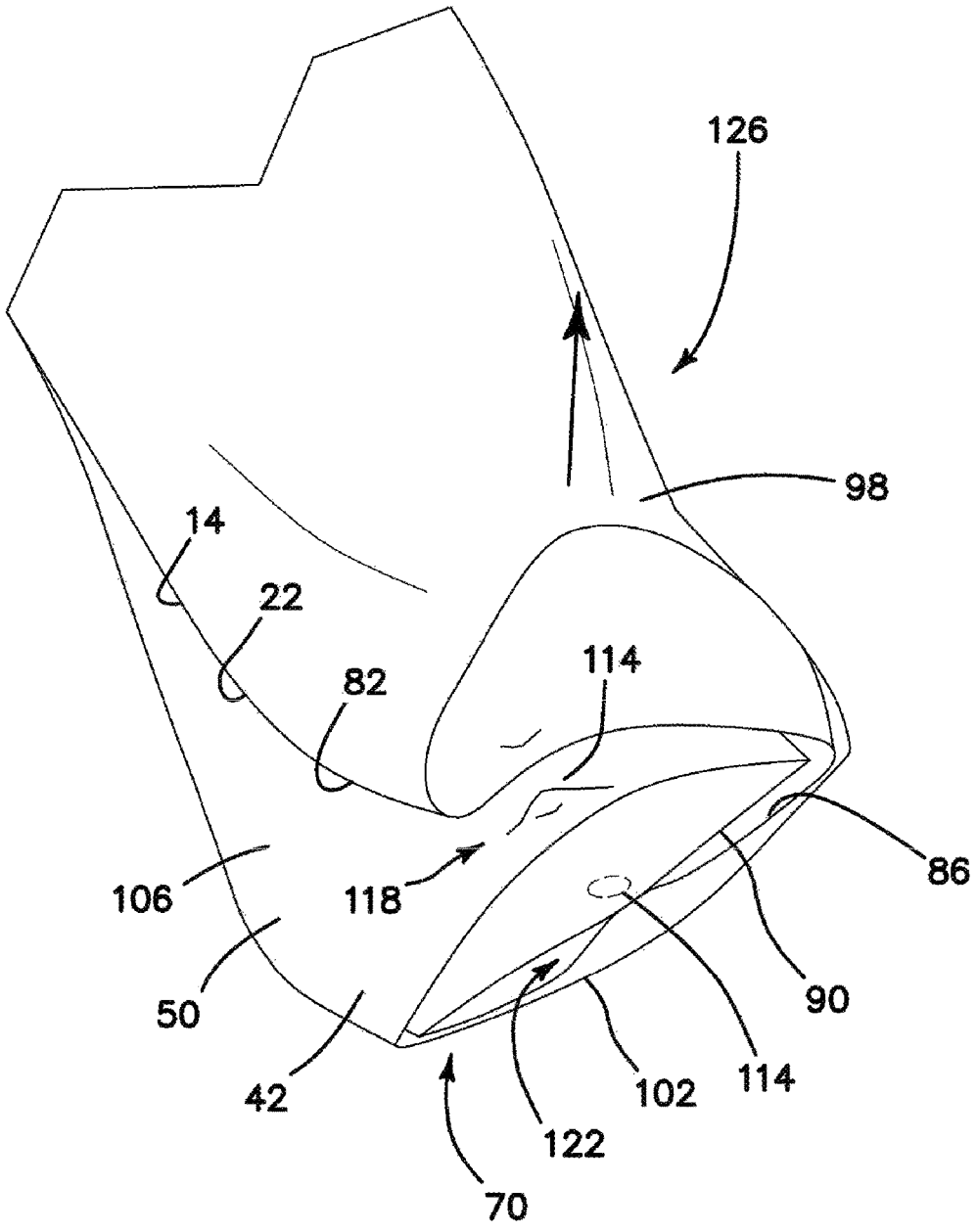
FIG. 2D is a perspective view of the FIG. 1 embodiment illustrating the parting of an attaching feature during bag opening.
Figure 3:
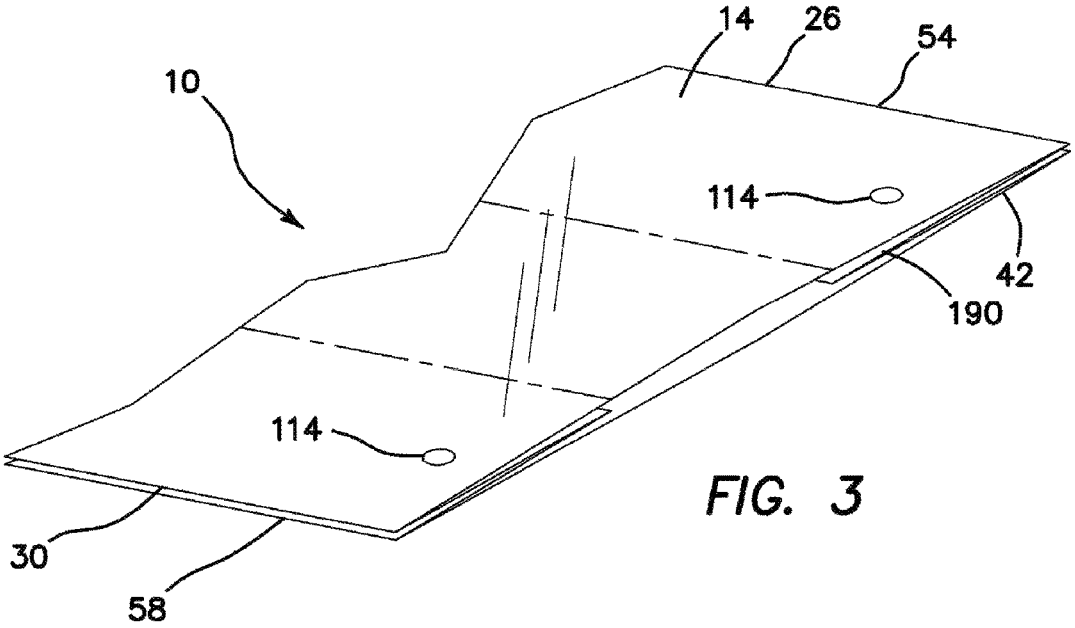
FIG. 3 is a perspective view of a gusseted C-fold Tri-fold bag with attaching features.
Figure 3A:
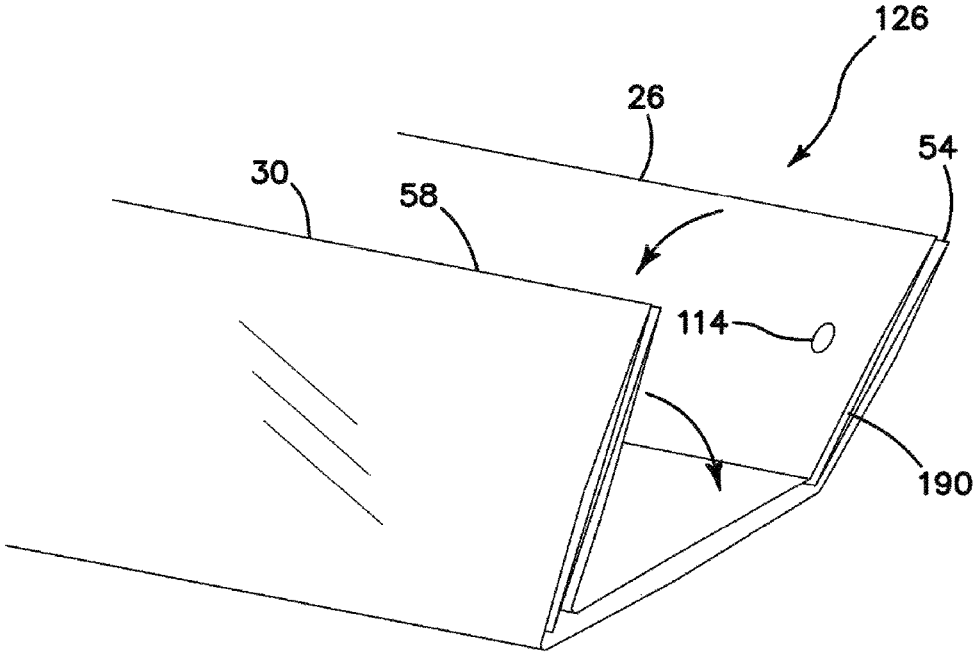
FIG. 3A is a perspective view of the FIG. 3 embodiment being folded.
Figure 4:
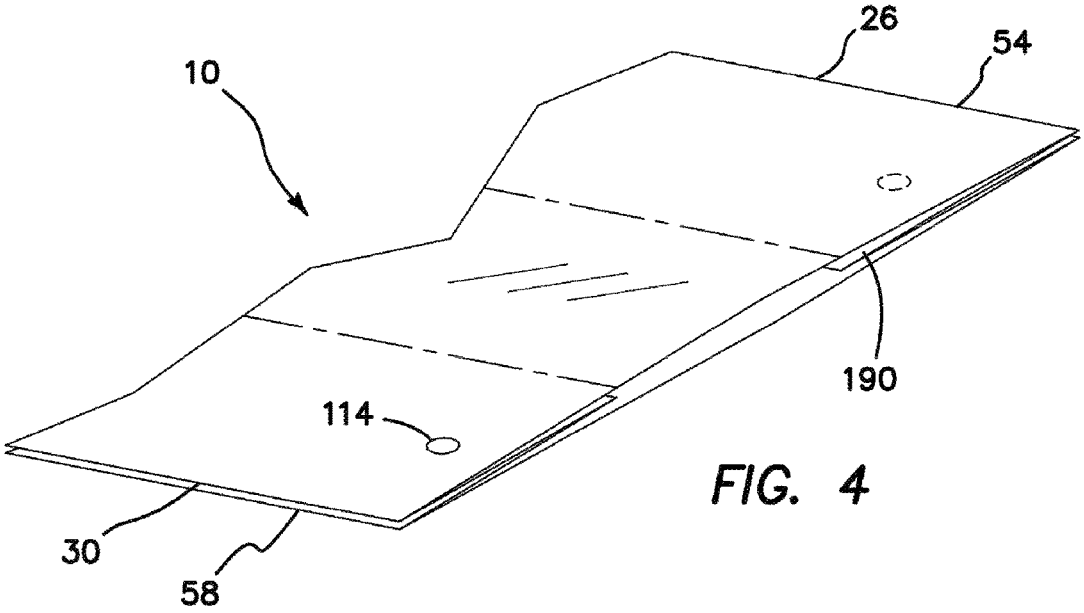
FIG. 4 is a perspective view of a gusseted Z-fold Tri-fold bag with attaching features.
Figure 4A:
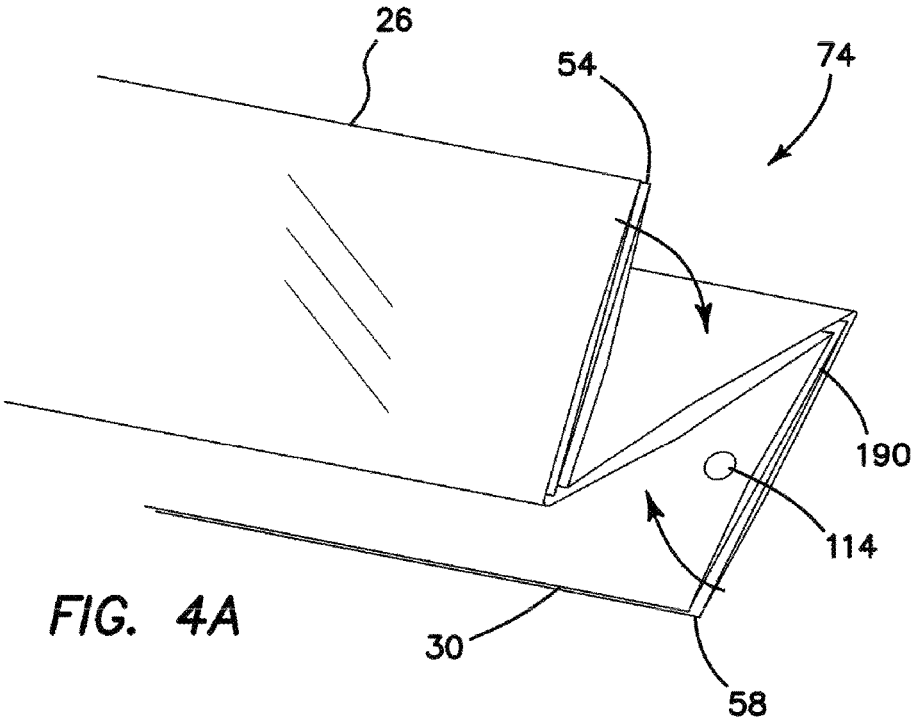
FIG. 4A is a perspective view of the FIG. 4 embodiment being folded.
Figure 5:
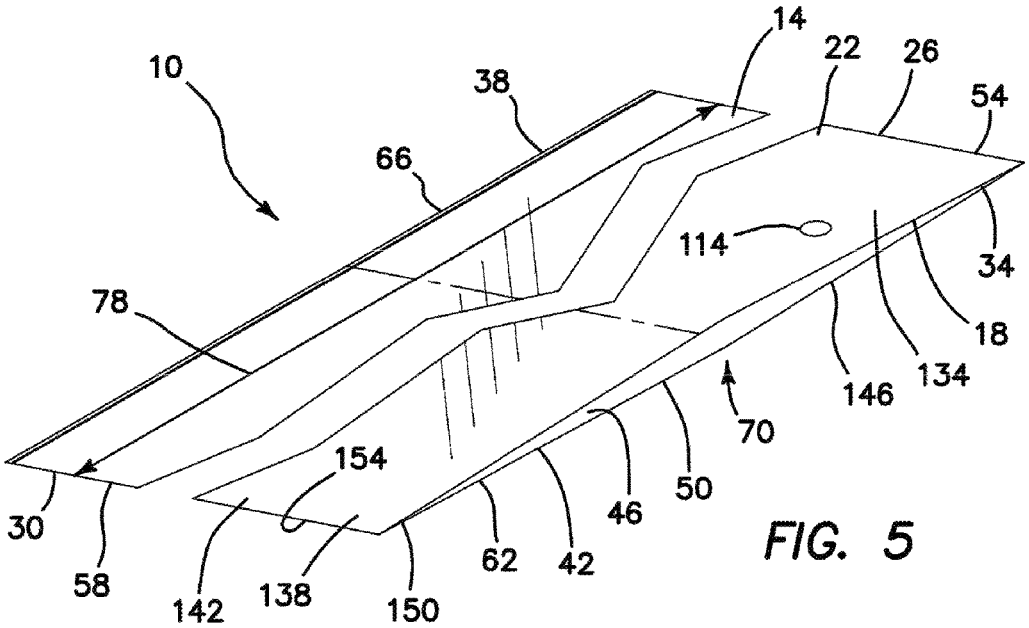
FIG. 5 is a perspective view of a once folded rectangular bag with attaching feature.
Figure 5A:
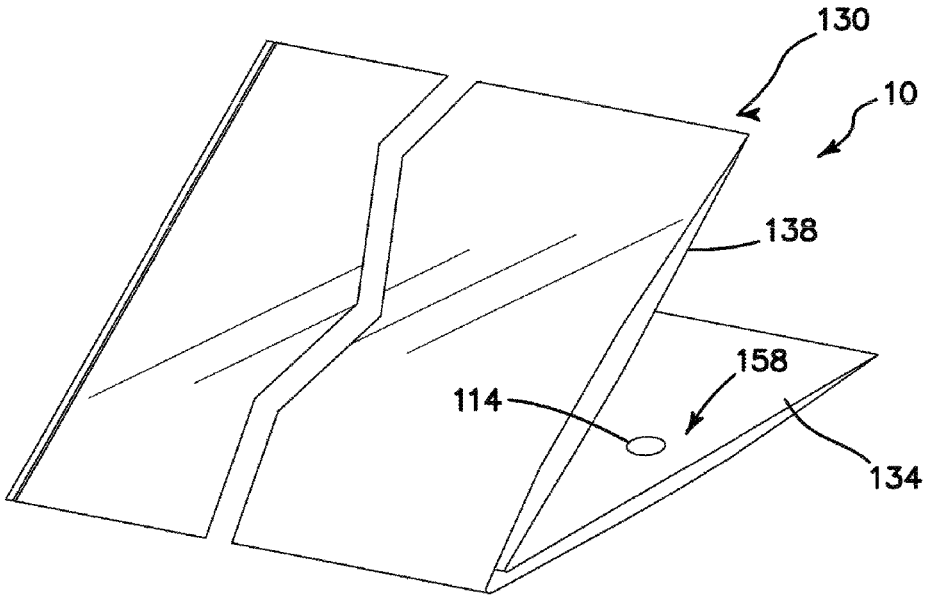
FIG. 5A is a perspective view of the FIG. 5 embodiment being folded.
Figure 6:
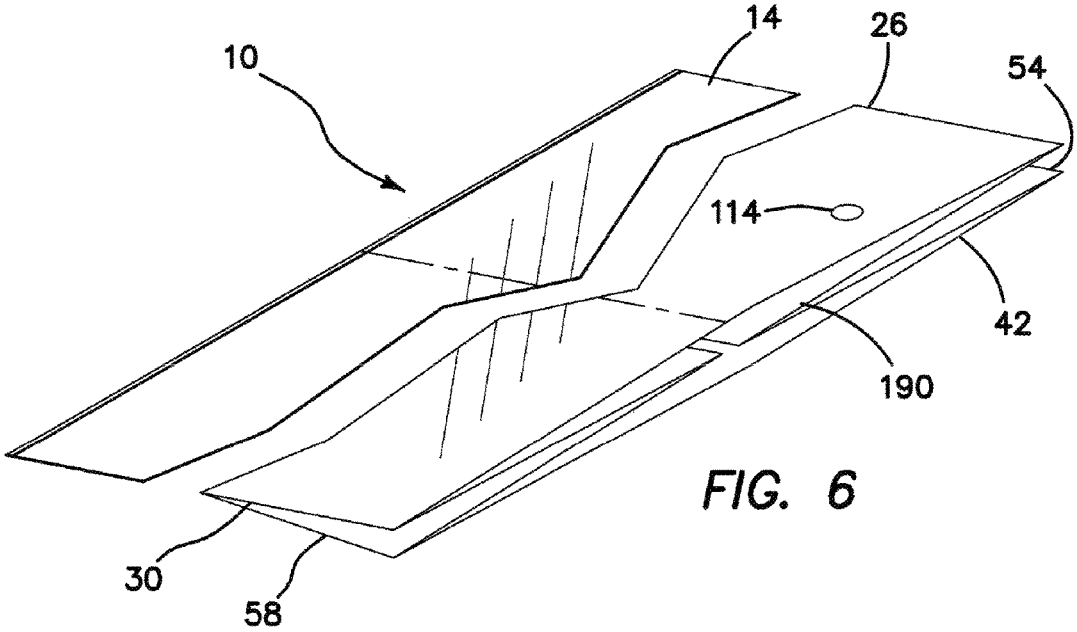
FIG. 6 is a perspective view of a once folded, gusseted rectangular bag with attaching feature.
Figure 6A:
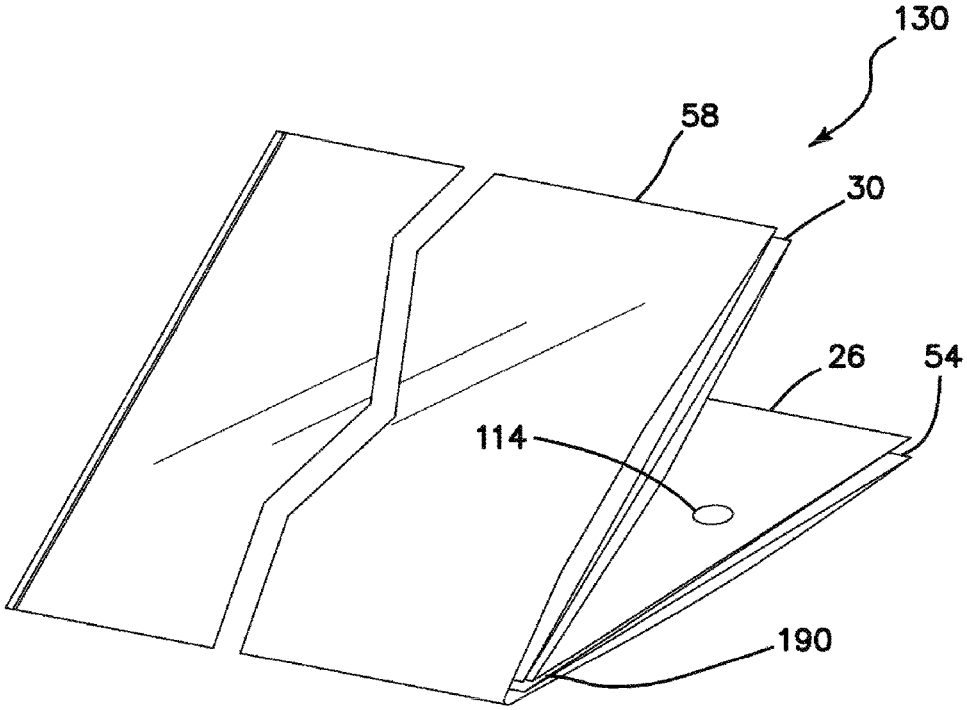
FIG. 6A is a perspective view of the FIG. 6 embodiment being folded.
Figure 8:
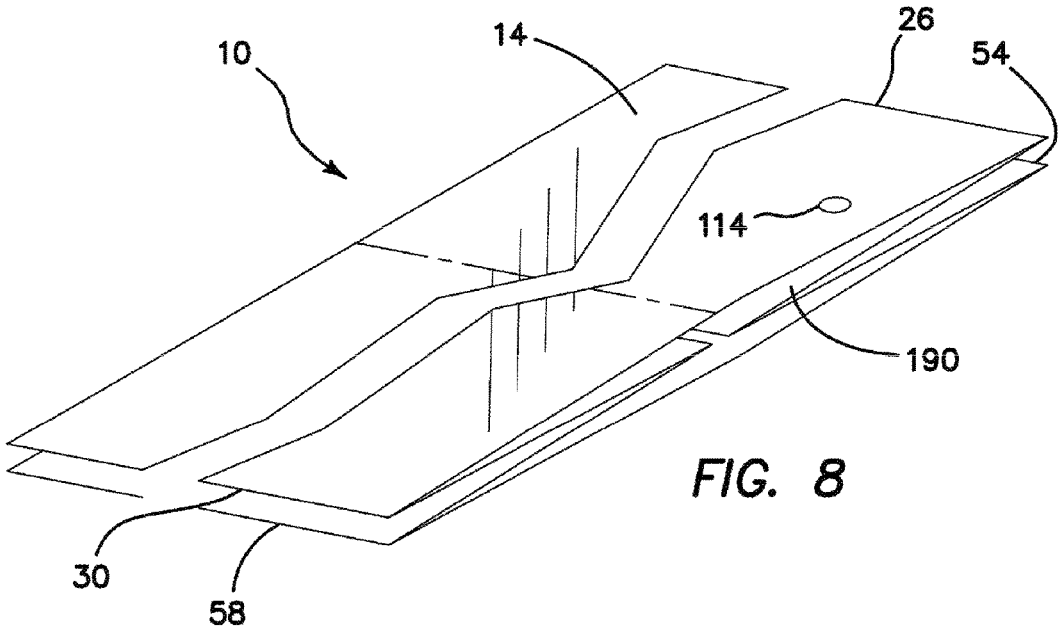
FIG. 8 is a perspective view of a once folded, gusseted rectangular bag with attaching feature prior to folding.
Figure 8A:
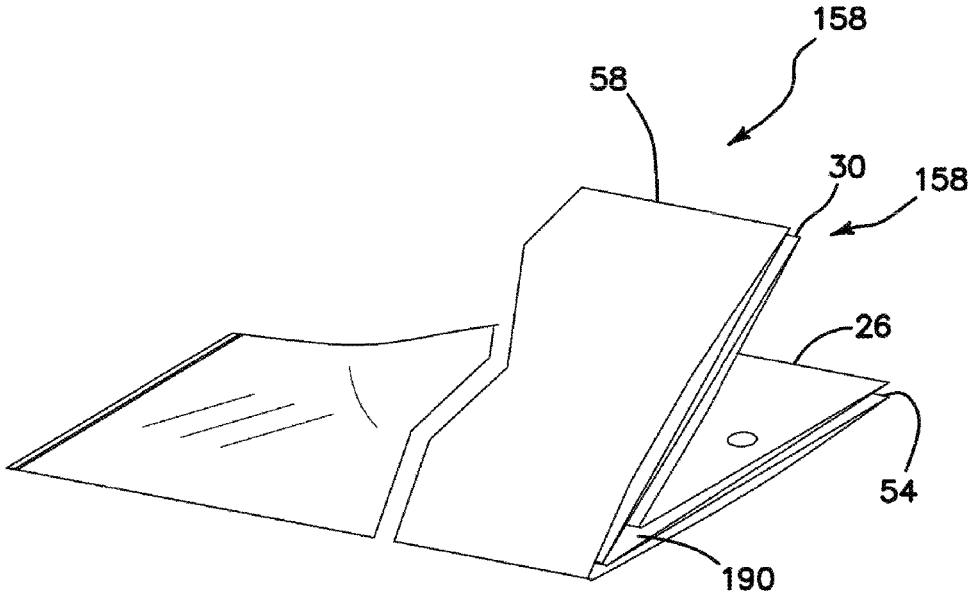
FIG. 8A is a perspective view of the FIG. 8 embodiment with bottom sealed after being folded.
Figure 8B:
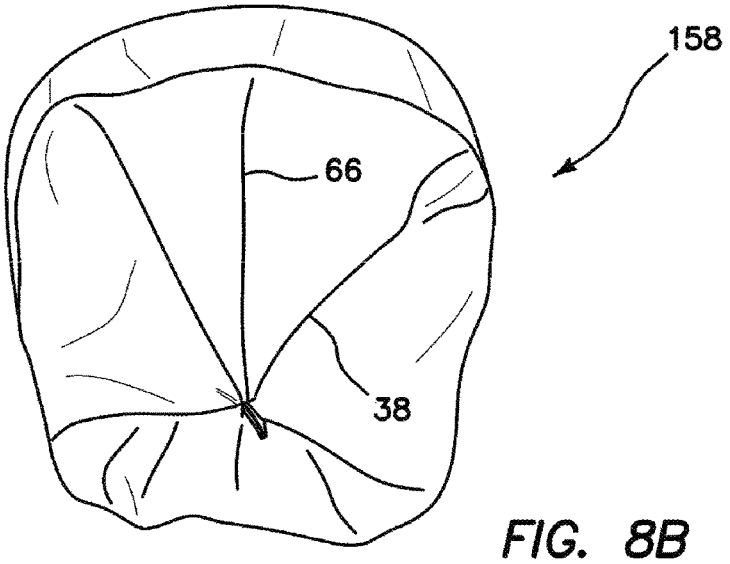
FIG. 8B is a bottom side perspective view of the FIG. 8 embodiment after bag opening.
Figure 11:
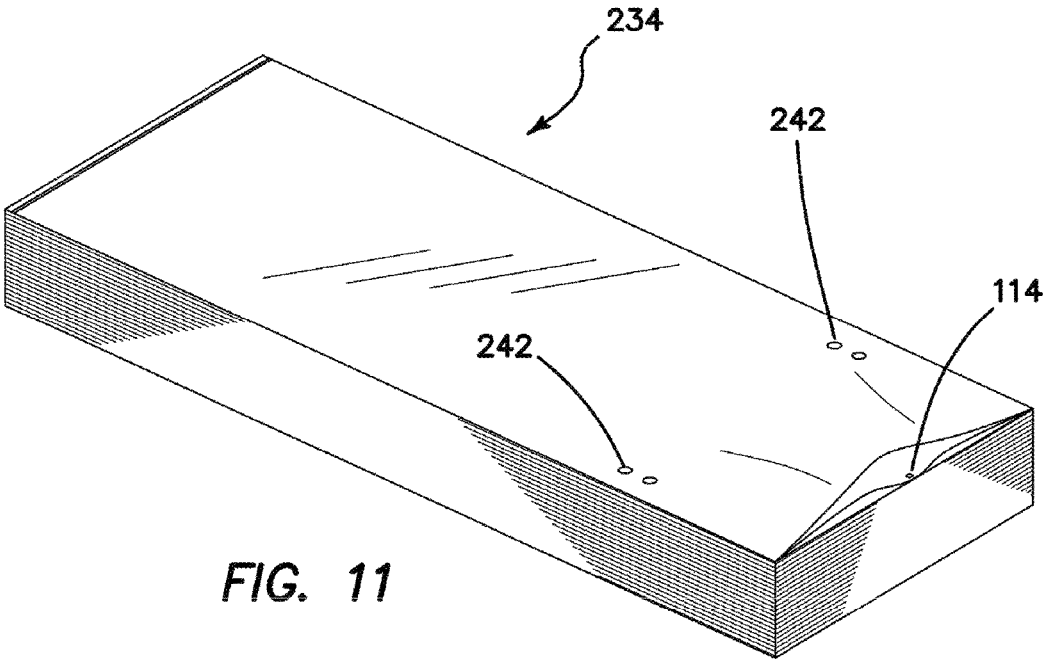
FIG. 11 is a perspective view of a stack of vertically folded bags with an attaching feature adjacent an upper end of the bag.

(3) In another variant, as illustrated in FIG. 2C, the bags 10 include a chisel cut 170. The chisel cut 170 extends through a center point 174 of the perforation line 162. When the compact roll 166 is installed in a bag dispenser 178 the chisel cut 170 will engage a separating tongue 182 when bags 10 are pulled from the roll 166.

(4) In still another variant, the bags 10 are rolled about a core 186.

(5) In yet another variant, as illustrated in FIGS. 3, 3A, 6, 6A, 8 and 8A, the bags 10 include at least one side gusset 190. The side gusset 190 extends inwardly from at least one of the first 26, 54 and second 30, 58 side edges of the front 14 and rear 42 walls.

(6) In a further variant, as illustrated in FIGS. 16, 16A, 16B and 16C, the bag 10 further includes a bottom gusset 194. The bottom gusset 194 extends upwardly from the bottom edges 38, 66.

Figure 9:
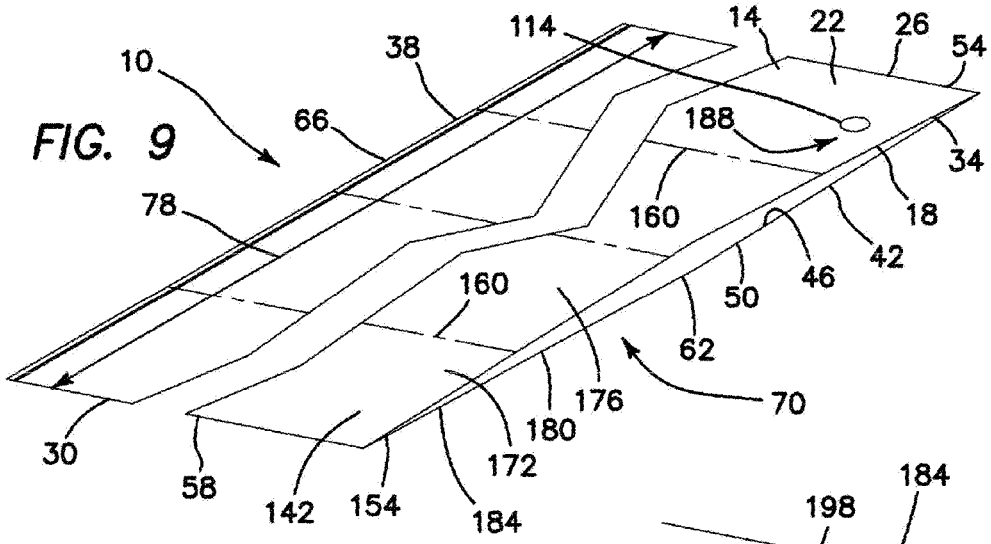
FIG. 9 is a perspective view of a multi-fold bag with attaching feature that is sealed prior to folding.
Figure 9A:
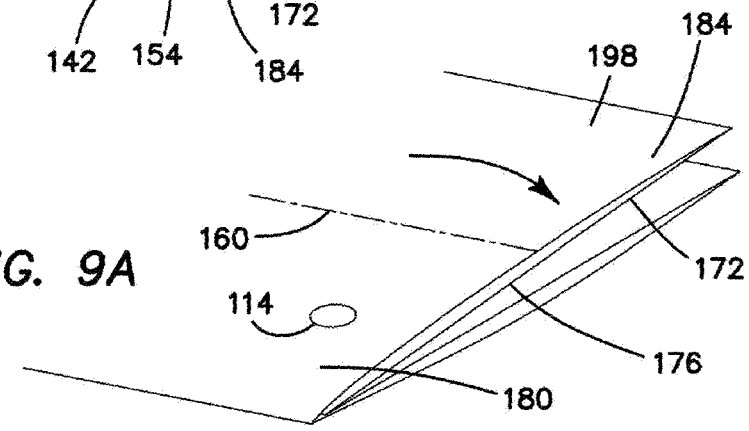
FIG. 9A is a perspective view of the FIG. 9 embodiment partially folded.
Figure 9B:
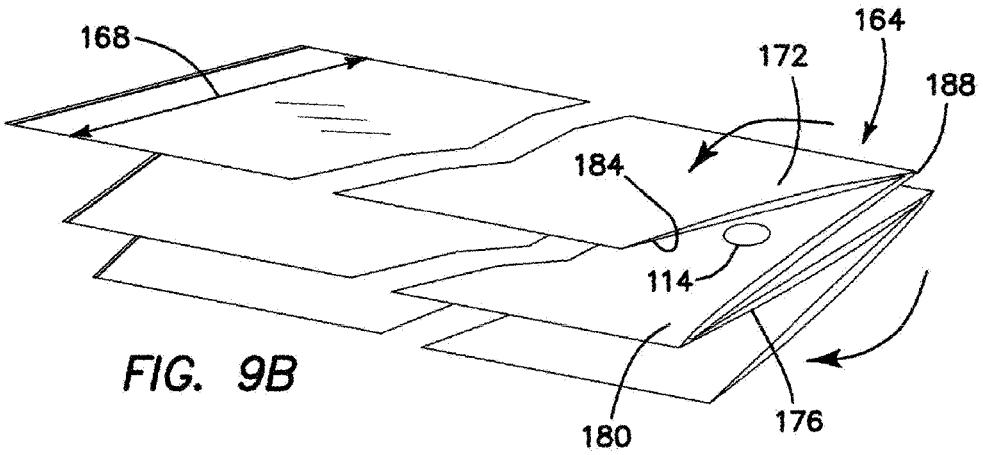
FIG. 9B is a perspective view of the FIG. 9 embodiment after folding.
Figure 10:
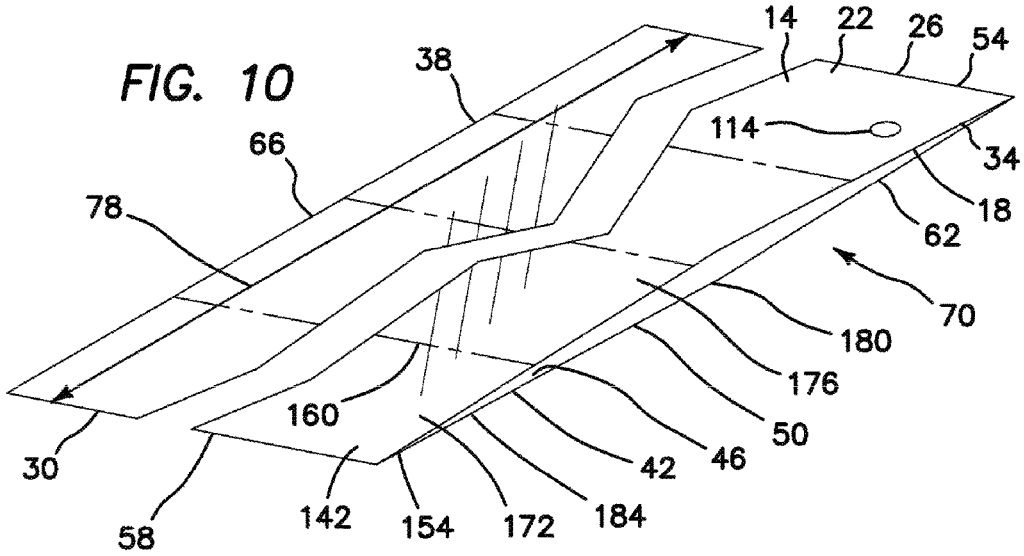
FIG. 10 is a perspective view of a multi-fold bag with attaching feature that is sealed after folding.
Figure 10A:
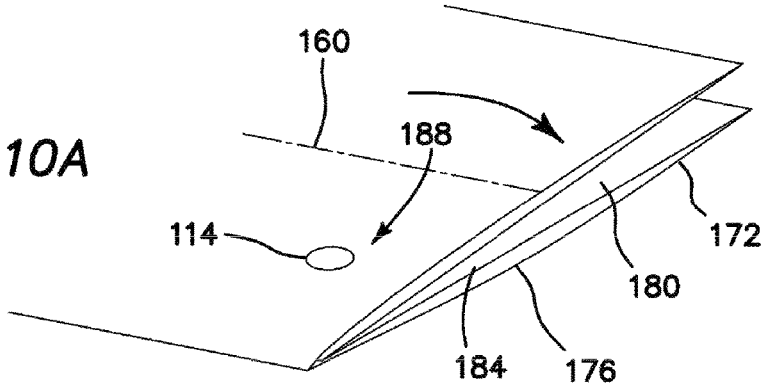
FIG. 10A is a perspective view of the FIG. 10 embodiment partially folded.
Figure 10B:
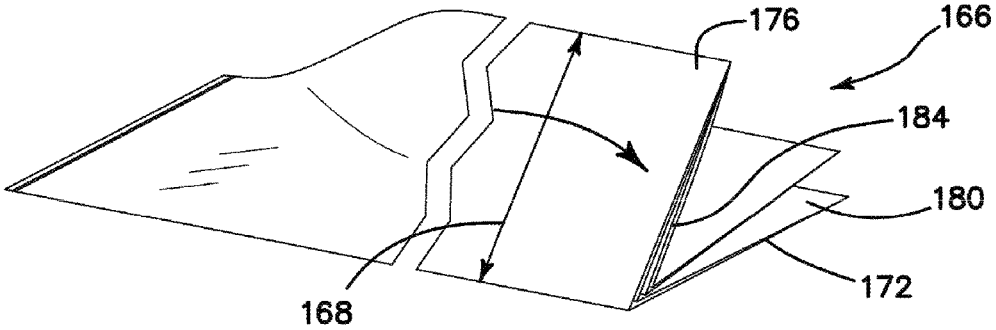
FIG. 10B is a perspective view of the FIG. 10 embodiment after folding.
Figure 12:
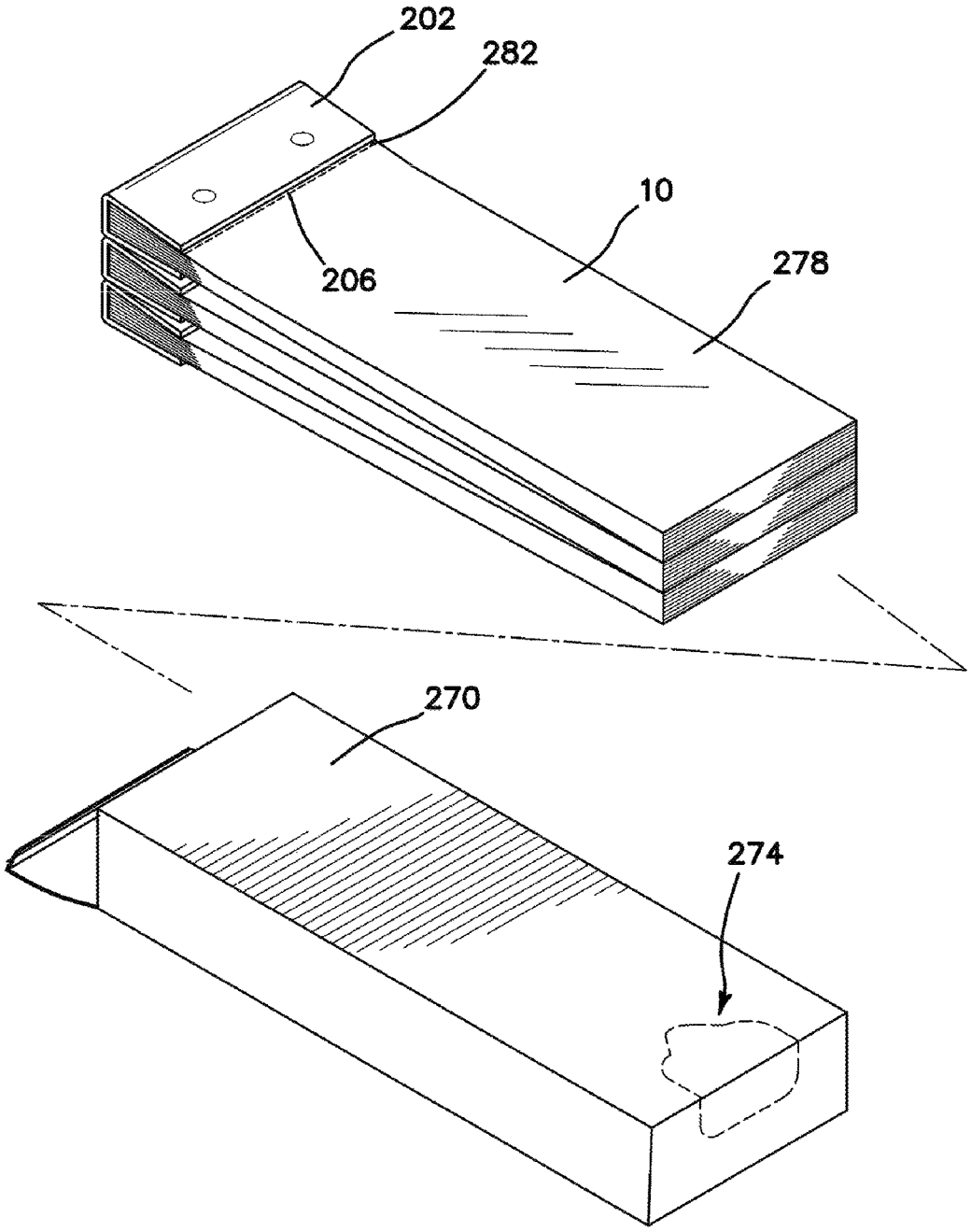
FIG. 12 is a perspective view of multiple stacks of header bags prior to insertion in a dispensing container.
Figure 13:
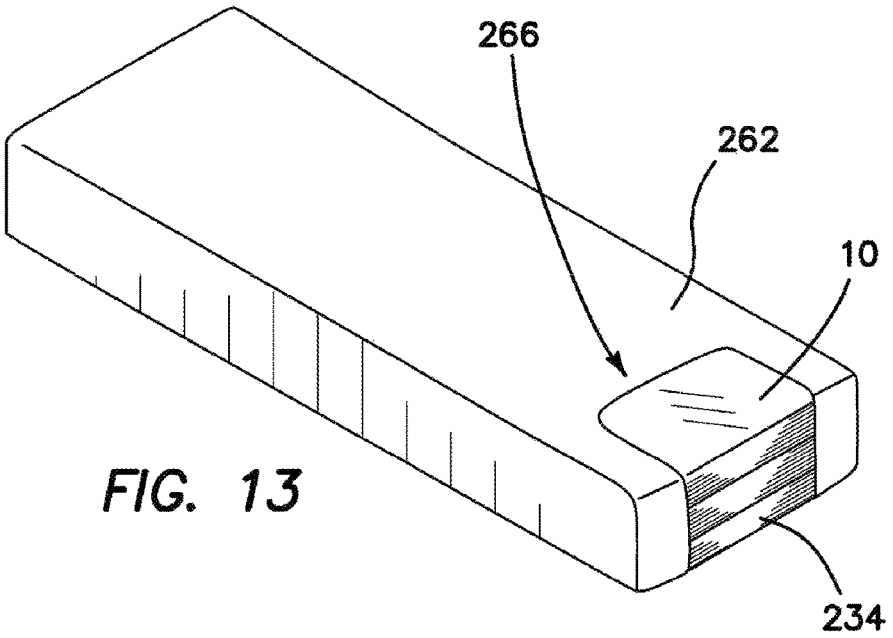
FIG. 13 is a perspective view of multiple stacks of bags enclosed in a flexible outer cover with dispensing aperture.
Figure 14:
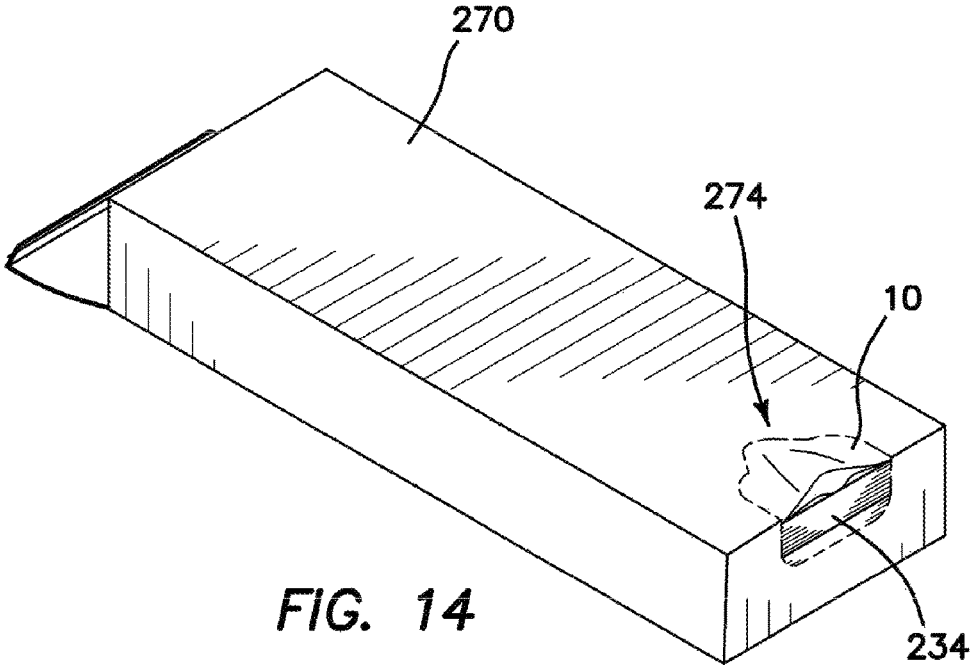
FIG. 14 is a perspective view of multiple stacks of bags in a dispensing container.
Figure 15:
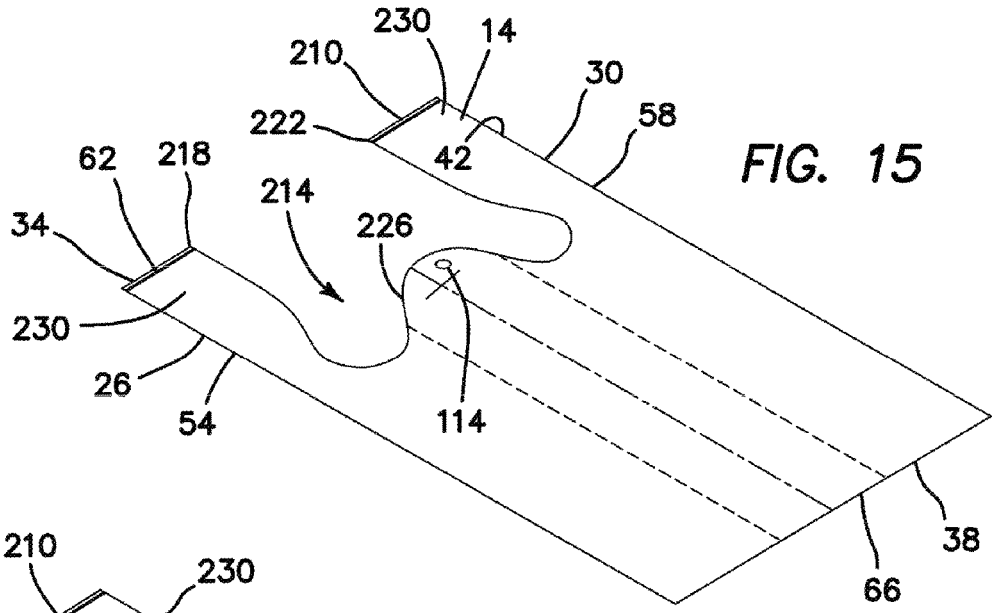
FIG. 15 is a perspective view of a t-shirt style bag with attaching feature that is sealed at the bottom after folding.
Figure 15A:
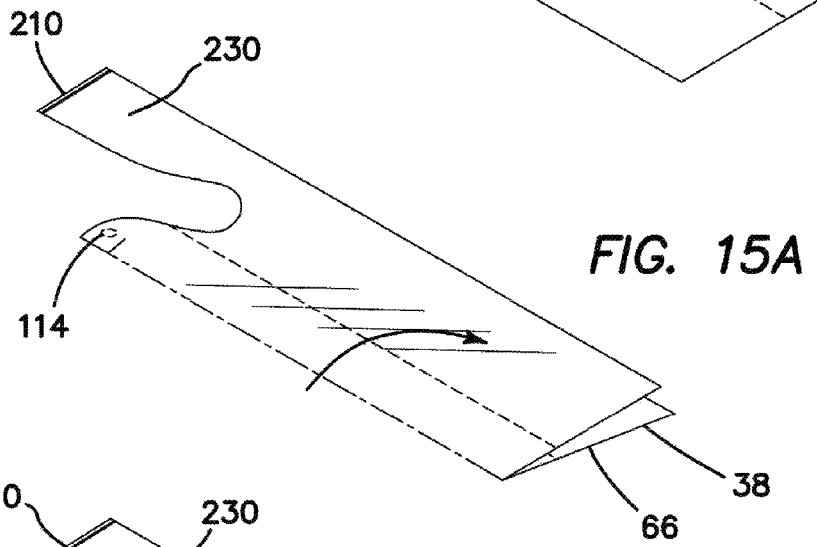
FIG. 15A is a perspective view of the FIG. 15 embodiment partially folded.
Figure 15B:
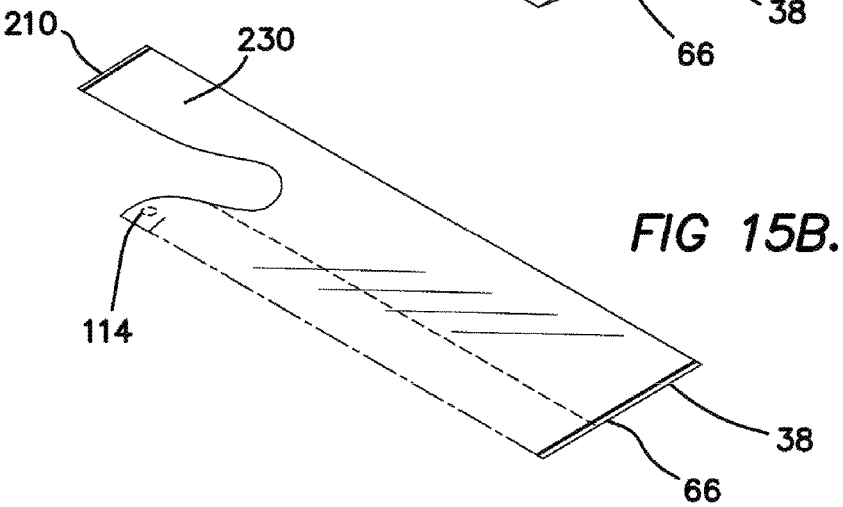
FIG. 15B is a perspective view of the FIG. 15 embodiment after folding.
Figure 16:
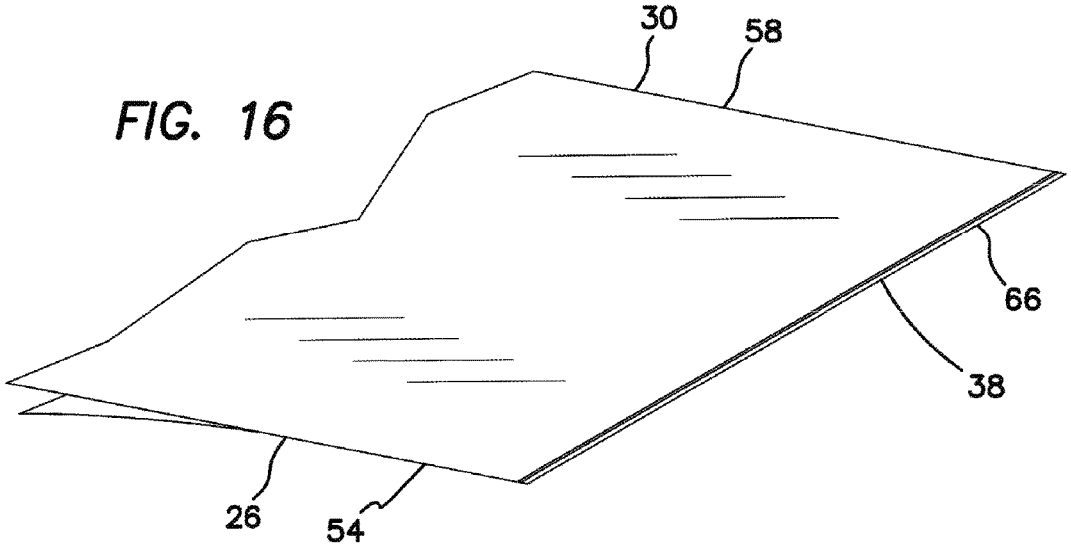
FIG. 16 is a perspective view of a portion of a film tube from which a bottom gusset bag with attaching feature is formed.
Figure 16A:
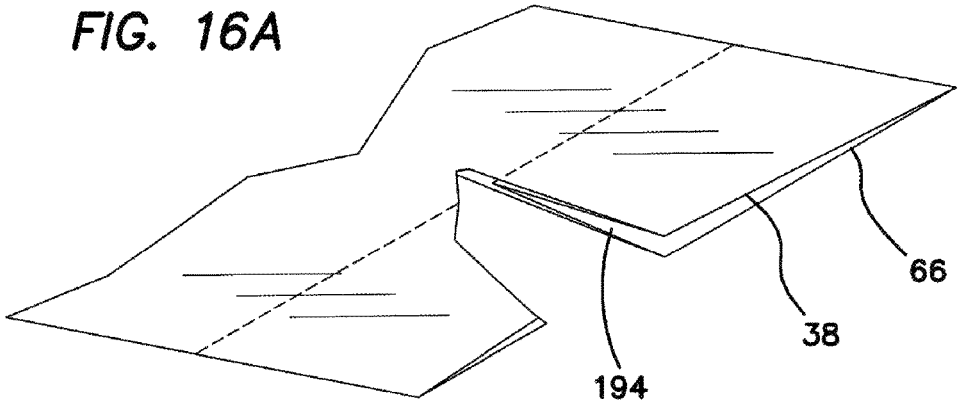
FIG. 16A is a partial perspective view of the FIG. 16 tube after formation of the gusset and sealing of the side edges.
Figure 16B:
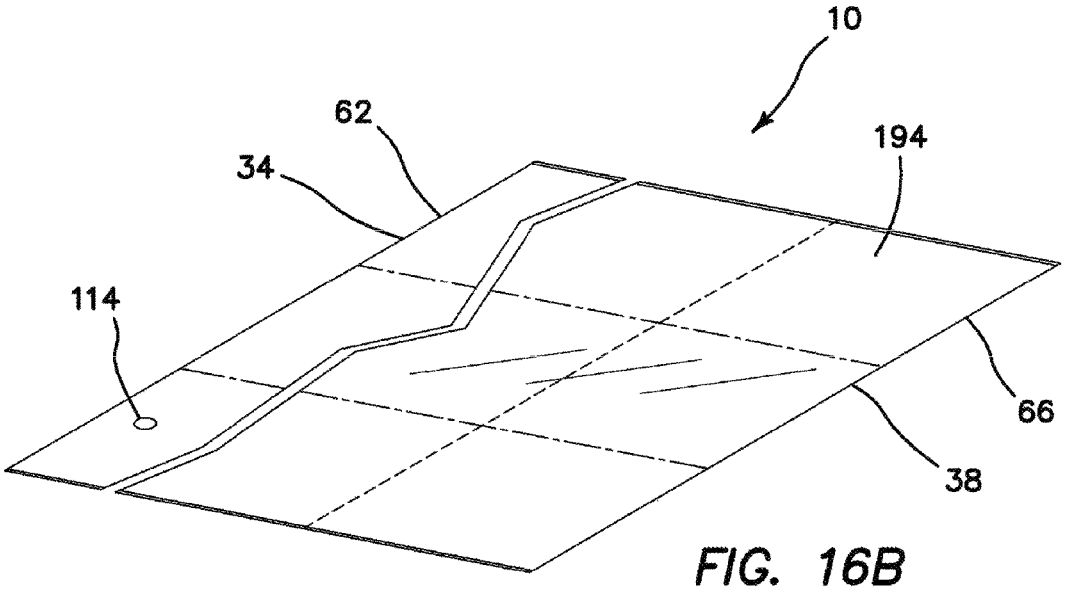
FIG. 16B is a partial perspective view of the FIG. 16 embodiment prior to folding.
Figure 16C:
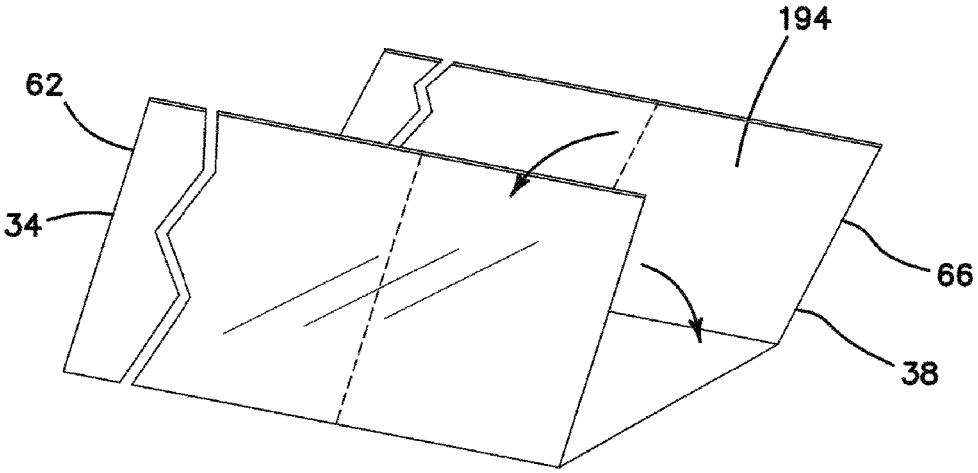
FIG. 16C is a partial perspective view of the FIG. 16 embodiment partially folded.

(7) In still a further variant, as illustrated in FIG. 9A, the outer surface 22, 50 of at least one of the front wall 14 and the rear wall 42 of the bags 10 is corona treated 198.

(8) In yet a further variant of the invention, the attaching feature 114 may be a natural or synthetic substance or other attaching means not requiring a separate substance.

(9) In another variant, the attaching feature 114 may be sprayed, rolled or dropped on the outer bag surfaces or may involve mechanical or electrical manipulation of the bag surfaces 18, 22, 46, 50.

(10) In a final variant, the attaching 114 feature comprises any of mechanical and electrical manipulation of said bag surfaces 18, 22, 46, 50.

The self-opening bags 10, have been described with reference to particular embodiments. Other modifications and enhancements can be made without departing from the spirit and scope of the claims that follow.

The invention claimed is:

1. A self-opening bag, comprising:

a front wall, said front wall having an inner surface, an outer surface, first and second side edges, a top edge and a bottom edge;

a rear wall, said rear wall having an inner surface, an outer surface, first and second side edges, a top edge and a bottom edge;

said front wall being joined to said rear wall adjacent respective first and second side edges thereof;

said front wall being sealed to said rear wall adjacent respective bottom edges thereof;

an open mouth disposed adjacent said top edges;

said bag being folded twice parallel to said side edges to form a Z-folded bag one third of a width of said bag;

said outer surface of said front wall having first, second and third portions, each of said portions having an upper end adjacent said open mouth;

said outer surface of said rear wall having fourth, fifth and sixth portions, each of said portions having an upper end adjacent said open mouth;

at least one attaching feature, said attaching feature being selected from the group comprising: cold staking, hot pinning, multiple corona treatment, corona treatment with pressure points, knife cutting with pressure, wherein said knife cutting with pressure causes edges of a knife cut through adjacent bag layers to adhere together, special resin formulations, and glue spotting;

said attaching feature disposed at at least one of a first point between said second portion and said third portion adjacent said upper end and a second point between said fourth portion and said fifth portion adjacent said upper end;

said attaching feature securing at least one of said second portion to said third portion and fourth portion to said fifth portion;

said bottom edges of said folded bag being releasably attached to said top edges of a subsequent folded bag;

said folded bags being rolled into a compact bag roll; and said at least one attaching feature causing said bag to open as said bag is pulled from said subsequent bag.

2. The self-opening bag, as described in claim 1, wherein said front and rear walls of each of said bags is removably attached by a perforation line at said bottom edges to said top edges of said subsequent bag.

3. The self-opening bag, as described in claim 1, further comprising:

a chisel cut, said chisel cut extending through a center point of said perforation line; and whereby, when said compact roll is installed in a bag dispenser said chisel cut will engage a separating tongue when bags are pulled from said roll.

4. The self-opening bag, as described in claim 1, wherein the bags are rolled about a core.

5. The self-opening bag, as described in claim 1, further comprising at least one side gusset, said side gusset extending inwardly from at least one of said first and second side edges of said front and rear walls.

6. The self-opening bag, as described in claim 1, further comprising a bottom gusset, said bottom gusset extending upwardly from said bottom edges.

7. The self-opening bag, as described in claim 1, wherein said outer surface of at least one of said front wall and said rear wall of said bags is corona treated.

8. The self-opening bag, as described in claim 1, wherein said attaching feature is any of a natural substance, a synthetic substance and other attaching means not requiring a separate substance.

9. The self-opening bag, as described in claim 1, wherein said attaching feature is any of sprayed, rolled and dropped on said outer bag surfaces.

10. The self-opening bag, as described in claim 1, wherein said attaching feature comprises any of mechanical and electrical manipulation of said bag surfaces.

* * * * *